US006089326A

United States Patent [19]

Drakin

[11] Patent Number: 6,089,326

[45] Date of Patent: Jul. 18, 2000

[54] METHOD AND APPARATUS FOR EXTINGUISHING FIRES

[75] Inventor: Nikolay Vasilyevich Drakin, Moskovskaya oblast, Russian Federation

[73] Assignee: R-Amtech International, Inc., Bellevue, Wash.

[21] Appl. No.: 09/291,993

[22] Filed: Apr. 15, 1999

[30] Foreign Application Priority Data

| | | | |
|---|---|---|---|
| Jul. 30, 1998 | [RU] | Russian Federation | 98113952 |
| Dec. 15, 1998 | [RU] | Russian Federation | 98122276 |

[51] Int. Cl.[7] ..... A62C 2/00; A62C 35/58

[52] U.S. Cl. ..... 169/46; 169/84

[58] Field of Search ..... 169/43, 44, 46, 169/11, 84

[56] References Cited

U.S. PATENT DOCUMENTS

| | | | |
|---|---|---|---|
| 4,197,213 | 4/1980 | Pietz | 169/46 |
| 5,188,257 | 2/1993 | Plester | 169/44 |
| 5,423,384 | 6/1995 | Galbraith | 169/84 |
| 5,865,257 | 2/1999 | Kozyrev | 169/46 |
| 5,884,710 | 3/1999 | Barnes et al. | 169/46 |

FOREIGN PATENT DOCUMENTS

| | | | |
|---|---|---|---|
| 1046807 | 12/1953 | France | 169/84 |
| 19546528 | 6/1997 | Germany . | |
| 94002970 | 6/1996 | Russian Federation . | |
| 2072135 | 1/1997 | Russian Federation . | |
| 2087170 | 8/1997 | Russian Federation . | |
| 2095104 | 11/1997 | Russian Federation . | |
| 2101054 | 1/1998 | Russian Federation . | |
| 9733653 | 9/1997 | WIPO . | |

*Primary Examiner*—Andres Kashnikow
*Assistant Examiner*—Jorge Bocanegra
*Attorney, Agent, or Firm*—Rothwell, Figg, Ernst & Manbeck, p.c.

[57] ABSTRACT

A method for extinguishing fire, wherein a gas an aerosol mixture is fed into a space includes steps of igniting a pyrotechnic composition that ensures a predetermined temperature profile during burning and a predetermined composition of the gas and aerosol mixture completely oxidizing the combustion products of incomplete combustion of the pyrotechnic composition by causing them to pass through a bed of catalytically active substances, which is located in the zone of the maximum temperature of the temperature profile of combustion of the pyrotechnic composition, with the temperature remaining constant by redistribution of said profile; cooling the combustion products and completely oxidizing them by reacting with substances having high heat absorbing capacity, concurrently with the filtering of the combustion products according to composition of the gas phase and particle size of the aerosol phase. An apparatus for extinguishing fire, having a casing (1) that has a discharge port (2), a combustion chamber (3) that is accommodated in the casing (1) and heat insulated from the walls of the casing (1), a pyrotechnic composition (4) and an igniter (5) that are received in the combustion chamber, a cooling section (9) and a complete catalytic oxidation section (6) that has a pair of spaced metal gratings (8*a*, 8*b*) between which a catalytically active substance is placed and that is located at a fixed distance from the pyrotechnic composition (4). A compensation device (10) is provided for maintaining the above-mentioned fixed distance during the burning of the pyrotechnic composition (4).

11 Claims, 5 Drawing Sheets

METHOD AND APPARATUS FOR EXTINGUISHING FIRES

FIELD OF THE INVENTION

The invention relates to fire fighting, and, more specifically, deals with a method for fire extinguishing with gas and aerosol mixtures that are released in burning pyrotechnic compositions.

DESCRIPTION OF THE BACKGROUND ART

Russian Patent 2 072 135 presents a method for fire extinguishing wherein a gas and aerosol mixture is released when a pyrotechnic charge burns, the mixture reacting with the combustion products in the fire area and resulting in the fire being extinguished. Before being supplied to a protected area, the gas and aerosol mixture is cooled; for that purpose, the mixture is combined with substances that have a high heat-absorbing capacity and a high degree of degassing such as carbonates, hydrates, hydroxides, and oxalates, which are used in the form of pellets or tablets.

An apparatus for carrying out this method has a casing that contains a pyrotechnic composition, a heat protection layer, and a discharge port. A pyrotechnic composition is ignited by means of a standard igniter. The cooling of the gas and aerosol mixture that is released during burning of the pyrotechnic composition is carried out in a cooling unit that has a form of a container which is filled with a cooling medium and is located in the casing between the pyrotechnic composition and the discharge port.

A serious disadvantage of this method and apparatus lies in the fact that the combustion products of the pyrotechnic composition, which consists of 12% $KClO_4$, 60% $KNO_3$, 18% $C_3H_5O$, and 10% Mg, are highly toxic. Upon thermal decomposition of such pyrotechnic compositions, toxic gases—$Cl_2$, NO, $NO_2$, $NH_3$, HCN, CO, and $CH_4$—are released.

The use of carbonates, hydrates, and oxalates as cooling media results in an additional increase in the concentration of toxic gases that are released when the cooling medium reacts with the hot gas and aerosol mixture. Thus $CO_2$, CO, $H_2O$, and $K_2CO_3$ are released upon decomposition of potassium oxalate—$K_2C_2O_4$, and MgO, $H_2O$, and $CO_2$ are released upon decomposition of magnesium carbonate $MgCO_3 \times 5H_2O$. The water vapor that is released can react with chlorine, nitrogen oxides, and carbon dioxide to form acids—HCl, $HNO_3$, $H_2CO_3$— which are also harmful for living organisms and for other objects present in the fire area.

For appropriate cooling of the gas and aerosol mixture, it is required that the above-mentioned substances have a mass that is equal to, or substantially greater than, the mass of the aerosol-forming mixture. This also results in an increased quantity of the toxic gases that are formed upon decomposition of the cooling medium.

Russian patent 2 101 504 presents a pyrotechnic composition that forms a gas and aerosol mixture, which comprises 67 to 72 percent by mass of potassium nitrate with a specific particle surface area of at least 1500 $cm^2/g$, 8 to 12 percent by mass of phenol-formaldehyde resin as a fuel binder, having a particle size that is not in excess of 100 $\mu$m, the balance comprising a gas- and aerosol-forming substance, namely dicyandiamide, having a particle size that is not in excess of 15 $\mu$m. The composition can also contain potassium carbonate, potassium benzoate, or potassium hexacyanoferrate in an amount of 4 to 12% by mass.

This pyrotechnic composition has the following disadvantages:

- Low flame propagation velocity of the composition (about 2.4 mm/s), which causes a low extinguishing rate. The composition has a broad combustion temperature profile (from the condensing phase of the composition to the hottest point of the flame), whereby it is difficult to cool the gas and aerosol mixture.
- Low content by mass (no more than 64%) of the solid phase, which is the main component of the gas and aerosol mixture for fire extinguishing.
- Toxicity of the combustion products of the pyrotechnic composition. More specifically, although there is a low content of such gases as $CO_2$ and $NH_3$ in the combustion products, the problem of toxicity is not fully resolved, because the concentrations of products of incomplete oxidation such as CO, NO, HNC are rather high.

Russian Patent 2 087 170 presents a method for fire extinguishing in spaces wherein solid fuel is added to combustion products, which are completely oxidized and cooled before being fed to a space being protected. The complete oxidation occurs in a jet flow, with an oxidizer being oxygen of the ambient air or other oxidizer formers, which are fed under pressure into a generator. Cooling of the combustion products occurs through heat exchange between the walls of a heat exchanger and a fluid coolant similar to the cooling system of a motor vehicle internal combustion engine.

This method has the following main disadvantages:

- Low efficiency of the process of complete oxidation of the products of incomplete combustion. The method is based on the use of the oxidizing gas that is taken from the ambient air by means of a jet. The concentration of oxygen that is taken from the air in a jet flow is not sufficient to ensure the complete oxidation of the gases that are formed when the composition burns. An increase in the oxygen concentration is only possible by raising the rate of ejection, which would require a greater size of the jet nozzle and a substantial increase in the gas and aerosol mixture flow velocity. This would cause an increase in the pressure within the combustion chamber, which would require a greater strength of the casing.

In case an oxidizer is to be supplied from a special pressurized gas bottle, which is required in some applications, the construction of the apparatus becomes more expensive.

Among other disadvantages are the following:

- Low efficiency of cooling of the combustion products with a liquid coolant by means of a known cooling system. Thus water and a coolant (a mixture of 40/60 of polyethylene glycol and water) is normally used, which has a boiling point over 100 to 130° C. In addition, in order to ensure the effective cooling of the gas and aerosol mixtures that are released as a result of combustion from 800 to 100° C., either a large heat exchange surface area is required, or the coolant flow velocity has to be high. In order to meet these requirements, a much larger metal container would be necessary, thus complicating the practical application of the device.

The closest prior art is described in Russian Patent Application 94 002 970 which presents a method for fire extinguishing in enclosed spaces comprising the following steps:

burning a charge of a composition that generates an aerosol;

cooling the resulting gas and aerosol mixture by causing it to pass through a heat-absorbent filling;

completely oxidizing the combustion products by causing the cooled gas and aerosol mixture to pass through an oxidizer filling;

feeding the gas and aerosol mixture to the fire area and extinguishing the fire.

Through all the steps, catalysts of oxidation of the combustion products are used, which are selected from metals including nickel, cobalt, iron, manganese, chromium, aluminum, magnesium, copper, platinum, silver, their oxides and or peroxides, salts, as well as their alloys and mixtures. The aerosol-forming composition, the heat-absorbent filling, and the oxidizer filling may be mixed with the above-mentioned catalysts or may be included in the respective compositions. Oxidizers are selected from among the following substances: ammonium nitrate, potassium nitrate, sodium nitrate, calcium nitrate, barium nitrate, strontium nitrate, ammonium perchlorate, potassium perchlorate, sodium perchlorate, and their mixtures.

The main disadvantage of this method is inefficient application of the oxidation catalysts. This results in the process of complete oxidation of the combustion products having a low efficiency, which, in turn, causes a higher level of toxic gases in the gas and aerosol mixture.

The low efficiency of the complete oxidation is explained by the following factors:

The above-mentioned catalysts in the gas and aerosol mixture generating composition or on the surface thereof have a catalytic effect on the reactions of decomposition of components that are present in the condensed phase of the composition but they do not have any practical effect on the reactions in the gas phase. The main result of the activity of these catalysts can only be deceleration or acceleration of decomposition of the components. As a result, the composition will burn either too slowly or too rapidly. This would not permit complete oxidation of the combustion products.

The above-mentioned catalysts in the chemical coolants mainly affect the rate of decomposition. More specifically, decomposition of the pellets or tablets of the heat-absorbent charge may have a catalytic effect on the CO, NO, HCN, $NH_3$ oxidation reactions. As a consequence of this, the gas temperature during the gas passage through the heat-absorbing charge decreases, thus lowering the efficiency of the complete oxidation.

The efficiency of a special oxidizer filling that is located directly in front of the discharge port is also not very high. This is primarily because the gas and aerosol mixture at this point is already cooled. Since the velocity of flow through the oxidizer filling is high, the reaction of total oxidation is not completed. In order to enhance the efficiency of the complete oxidation, the oxidizer filling should be made thicker. This will result in lower discharge velocity and also in higher pressure build-up in the casing of the apparatus, which may cause the casing to blow up.

Therefore, the state of the art does not allow the required properties to be obtained simultaneously, namely:

low toxicity of the gas and aerosol mixture;

low temperature of the gas and aerosol mixture, while having high fire extinguishing efficiency.

SUMMARY OF THE INVENTION

The method and apparatus for fire extinguishing according to the invention ensure effective extinguishing of fire under extreme fire situations and also ensure survival of personnel and other living creatures present in the fire area.

The present invention is based on the following technical problems:

reduction of toxicity of the fire extinguishing gas and aerosol mixture that is fed to a space being protected, primarily by lowering the level of NO, CO, $NH_3$, HCN and by lowering the content of aerosol particles of a size smaller than 1 $\mu$m.

Lowering the temperature of the fire extinguishing gas and aerosol mixture that is fed to a space being protected to rule out the presence of flames and sparks in the area, thus enhancing the fire extinguishing efficiency of the gas and aerosol mixture.

The above technical problems are solved by means of the present method for fire extinguishing that includes feeding a gas and aerosol mixture to a space being protected, comprising the following steps:

a) igniting a pyrotechnic composition that ensures a predetermined temperature profile during burning and a predetermined composition of the gas and aerosol mixture;

b) completely oxidizing the combustion products of incomplete combustion of the pyrotechnic composition by causing them to pass through a bed of catalytically active substances, which is located in the zone of the maximum temperature of the temperature profile of combustion of the pyrotechnic composition, with the temperature remaining constant through redistribution of said profile;

c) cooling the combustion products and completely oxidizing them by reacting with substances having high heat absorbing capacity, concurrently with the filtering of the combustion products according to composition of the gas phase and particle size of the aerosol phase.

The pyrotechnic composition that ensures a predetermined composition of the gas phase and a predetermined temperature profile comprises dicyandiamide as a gas and aerosol former, a polycondensate of formaldehyde with phenol as a combustible binder, and potassium nitrate as an oxidizer. The gas and aerosol former, the combustible binder, and the oxidizer each consist of two fractions: 40 to 80 $\mu$m and 7 to 15 $\mu$m in the mass ratio of 80:20; 70 to 120 $\mu$m and 10 to 25 $\mu$m in the mass ratio of 70:30; and 15 to 25 $\mu$m and 1 to 7 $\mu$m in the mass ratio of 25:75, with the following proportions of the components in the composition (% by mass):

| | |
|---|---|
| Gas and aerosol former | 9 to 20 |
| Combustible binder | 6 to 14 |
| Oxidizer | remainder. |

During burning, the above-described composition ensures:

constant temperature profile during burning (from 460° C. in the condensed phase to 750° C. at the hottest point of the flame);

constant gas phase-to-aerosol ratio of 30:70, with the pass part of the aerosol particles of a size from 1 to 2 $\mu$m being no less than 70%;

stability of the chemical composition and concentration of the gas phase that is released during burning of the composition.

If it is necessary to increase the combustion rate of the pyrotechnic composition, the part containing smaller-sized particles is to be increased. This can be achieved by using gas and aerosol forming dicyandiamide with particles of 40 to 80 μm and 7 to 15 μm in the mass ratio of 10:90, the oxidizer, potassium nitrate with particles of 15 to 25 μm and 1 to 7 μm in the mass ratio of 5:95, and the combustible binder in the form of a polycondensate of formaldehyde with phenol, with the following proportions of the components in the composition (% by mass):

| | |
|---|---|
| Gas and aerosol former | 9 to 20 |
| Combustible binder | 6 to 14 |
| Oxidizer | remainder. |

The particles of phenol-formaldehyde resin may first be dissolved in ethanol. The resulting 60% solution is used for the preparation of the pyrotechnic composition. During preparation of the composition, ethanol is removed. This solution ensures a temperature profile from 460° C. in the condensed phase to 1050° C. at the hottest point of the flame.

According to current knowledge on toxicity of combustion products of liquid and pulverous substances (V. S. Ilichkin, V. G. Vasil'ev, V. L. Smimov. "Eksperimental'noe obosnovanie methodov opredeleniya toksichnosti produktov goreniya zhidkikh i poroshkoobraznykh veshchestv" (in Russian) [Experimental support of the methods for determining toxicity of combustion products of liquid and pulverous substances] *Pozharovzryvobezopasnost',* 1997, No. 4, p.11–15), practically all organic substances that contain carbon and nitrogen in their molecules, which may potentially be components of a gas and aerosol mixture upon their thermal oxidizing decomposition and burning, release toxic gaseous substances such as NO, CO, $CO_2$, HCN, $NH_3$, etc. In order to minimize the harmful toxic impact of the fire-extinguishing gas and aerosol mixture on humans, living organisms, and the environment, a method for feeding the gas and aerosol mixture to a space being protected and an apparatus for carrying out the method must ensure the effective neutralization of such gases. In doing this, the step of complete oxidation is carried out on the surface of a catalytically active substance selected from the group of artificial aluminosilicates (e.g., zeolites).

The following types of zeolites are currently known: KA, NaA, NaX, which are of the types 3A, 4A, 13X, respectively, following the US classification. The structure of the type A zeolite consists of smaller and larger adsorbing pores. The chemical formula of NaA zeolite is the following: $Na_2O.Al_2O_3.2SiO_2.4SH_2O$. An elementary cell consists of a larger pore and a smaller pore. The larger pore has a substantially spherical shape with a diameter of 1.14 nm. It is connected through an eight-member oxygen ring 0.42 nm in diameter with six adjacent larger pores and through a six-member oxygen ring 0,22 nm in diameter with eight smaller pores. FIG. 1 shows the structure of the type A synthetic zeolite (a) and of the type X synthetic zeolite (b). The type X zeolite has a similar structure. The difference here is in the fact that each larger pore has four inlet openings that are built by twelve-member oxygen rings with a diameter of 0.8 to 0.9 nm. This makes the structure of zeolite of this type more open for gas molecules to pass through (N. V. Kel'tsev. "Osnovy adsorbtsionnoy tekhniki" (in Russian) [Fundamentals of adsorption technology]. M. Khimiya. 1984).

A hot gas and aerosol mixture that is released in burning the pyrotechnic composition (τ≈750° C.) heats the zeolite surface. The temperature increase makes oscillations of the zeolite lattice stronger, thus facilitating penetration of the gas molecules into the adsorption cavities that are built of the oxygen rings. Conditions within the pores (temperature and pressure) are such that the following catalytic neutralization reaction occurs on the active surface of the zeolite pore:

$$2NO^{\tau} \rightarrow N_2 + O_2;\ 2CO^{\tau} \rightarrow 2C + O_2 \quad (1)$$

Oxygen that is liberated as a result of this reaction is used for complete oxidation of the products of incomplete combustion of the pyrotechnic composition:

$$\begin{aligned} 2CO + O_2 &\longrightarrow 2CO_2 \\ 2H_2 + O_2 &\longrightarrow 2H_2O \\ 2NH_3 + 1.5O_2 &\longrightarrow N_2 + 3H_2O \\ CH_4 + 2O_2 &\longrightarrow CO_2 + 2H_2O \end{aligned} \quad (2)$$

The neutralization reaction (1) and the following reactions of complete oxidation (2) occur effectively at temperatures above 700° C. The zone of complete oxidation has a form of a zeolite bed that is enclosed between two metal gratings and is located in the area of the highest combustion temperature (750° C.) of the above-mentioned pyrotechnic composition. If the temperature is below 700° C., the rate of reactions (1) and (2) decreases. If the temperature is above 800° C., thermal oscillations of the zeolite lattice become too strong and cause collapse of the pores, so the reaction does not occur. It is, therefore, preferred that the catalytically active substance be in the form of artificial pellets of activated aluminum oxide ($Al_2O_3$) with the porous structure. These pellets are capable of withstanding thermal oscillations of the structure up to 1100° C. without destruction.

The efficiency of the catalytic reactions can be improved by placing zeolite on a copper or copper alloy grating. During the thermal oscillations of the zeolite structure, $Cu^{2+}$ cations can replace $Na^+$ cations of this structure. Under the effect of the hot gas and aerosol mixture, the modified zeolite has the enhanced catalytic activity, whereby the concentration of the toxic gases in the gas and aerosol mixture decreases.

Highly porous activated aluminum oxide can be used as a catalytically active substance with a large specific surface area (300 to 345 $m^2/g$).

After the catalytic oxidation, the gas phase is admitted to a space that separates the complete oxidation section from the cooling section, in which it mixes with the solid phase of the products of combustion of the pyrotechnic composition.

The gas and aerosol mixture, which is cleaned from the toxic products of incomplete combustion, is cooled at the direct contact with the solid coolant. The solid coolant is comprised of highly heat-absorbent materials such as silica gel, zeolite and their mixtures, as well as aluminum oxides. These materials have a large specific surface and highly porous structures to adsorb various chemical compounds including water. Thus the volume of the larger pores of the type "A" zeolite is $V_b$=0.776 $nm^3$. This volume can receive up to 24 molecules of water.

The cooling of the gas and aerosol mixture with the above-mentioned solid coolants occurs through heat exchange. During this process, the heat of the hot mixture is used for heating the solid coolant, for desorption of water and for transformation of water into vapor. Carbon, which is released in burning the pyrotechnic composition as a result of reaction (1), takes part in an endothermic reaction with the water vapor as follows:

$$C+2H_2O \rightarrow CO_2+2H_2-178.15\ kJ \quad (3).$$

This also contributes to additional cooling of the gas and aerosol mixture. As a result, the mixture that is admitted to the space being protected has a lower temperature and is free from sparks and flames. The fire-extinguishing effect of the mixture is determined by a combination of the two following factors:

heat transfer from the fire flames;

deactivation of the active atoms and radicals of the fire flames on the surface of the highly active solid aerosol particles. Fire is extinguished in a few seconds, and there is no harmful effect on living organisms and environment.

Comparison of the above-described method with the state of the art shows the following distinctive features:

the process of the complete catalytic oxidation of the products of incomplete combustion is carried out:

a) before cooling the gas and aerosol mixture;

b) on a large specific surface area of substances selected from the group of aluminosilicates, e.g., zeolites;

c) in the zone of the maximum temperature (750° C.) of the temperature profile of combustion of the pyrotechnic composition, whereby the maximum temperature value remains unchanged until the end of combustion;

d) with the subsequent mixing in the space between the complete oxidation section and the cooling section;

The use of the above-described pyrotechnic composition that ensures a stable temperature distribution and gas phase composition, which contains dicyandiamide as a gas and aerosol former, a polycondensate of formaldehyde with phenol as a combustible binder, and potassium nitrate as an oxidizer. The gas and aerosol former, the combustible binder, and the oxidizer each consist of two fractions, respectively: 40 to 80 μm and 7 to 15 μm in the mass ratio of 80:20, 70 to 120 μm and 10 to 25 μm in the mass ratio of 70:30, and 15 to 25 μm and 1 to 7 μm in the mass ratio of 25:75, with the following proportioning of the components (% by mass):

| | |
|---|---|
| Gas and aerosol former | 9 to 20 |
| Combustible binder | 6 to 14 |
| Oxidizer | remainder. |

The use of a solid coolant selected from the group of silica gel, aluminosilicate (zeolite).

The above-described fire-extinguishing method cannot be used to its full advantage with the employment of prior art devices.

A prior art apparatus for extinguishing fire (RU 2 072 135) has a casing that contains a pyrotechnic composition, a heat insulating layer, a discharge port, an igniter, and a cooling section. The cooling section comprises a space filled with coolant pellets or tablets, which is located between the pyrotechnic charge and the discharge port. The coolant is selected from carbonates, hydrates, hydroxides, and oxalates, which have high heat absorbing capacity and high gas release capacity.

This prior art apparatus is disadvantageous primarily because it cannot ensure generation of a non-toxic gas and aerosol mixture. This is due to the fact that the cooling section is positioned in front of the discharge port, and the cooling process itself results in toxic carbon monoxide being released, which is admitted with the gas and aerosol mixture to the space being protected without complete oxidation and filtration.

Another prior art apparatus disclosed in Russian patent Application 94 002 970 has a thermocontrolled container that contains a sequence of an aerosol-generating charge, a heat-absorbing charge, and an oxidizer charge that is located in front of the discharge port. All the above-mentioned charges can contain oxidation catalysts selected from the following metals: nickel, cobalt, iron, manganese, chromium, aluminum, magnesium, copper, platinum, silver, as well as their oxides and/or peroxides, salts of the above-mentioned metals, their alloys and mixtures. The heat-absorbing charge can also contain 10 to 60% by mass of an oxidizer selected from nitrates of ammonium, potassium, sodium, calcium, barium, and strontium, perchlorates of ammonium, potassium and sodium, or their mixtures.

The above-described apparatus is deficient primarily due to the high toxicity of the fire-extinguishing gas and aerosol mixture. This disadvantage stems from the choice of oxidizer. Upon decomposition, these substances release toxic products in addition to oxygen that is used for complete oxidation of CO, NO, $NH_3$, HCN. Thus the nitrates liberate NO and $NO_2$, and the perchlorates release HCl, $NH_3$, and $Cl_2$. Regardless of the form in which the oxidizers of these types are used, as a component of the heat-absorbing charge or as a separate oxidizer charge, the gas and aerosol mixture discharged from this apparatus contains toxic products.

An apparatus according to the invention eliminates the above disadvantages.

The apparatus according to the invention is based on the following technical problems:

lowering the toxicity of the fire-extinguishing gas and aerosol mixture owing to the high-efficiency of the complete oxidation of the combustion products;

simplified construction of the apparatus with higher fire-extinguishing efficiency and safety during use.

The above technical problems are solved by providing an apparatus for extinguishing fire, comprising a casing with a discharge port, a combustion chamber that is heat insulated from the casing and contains a pyrotechnic composition, a section for the complete catalytic oxidation, which comprises a pair of metal gratings, with the space between the gratings being filled with a catalytically active aluminosilicate (e.g., zeolite pellets). A cooling section is located over the complete oxidation section. A space between the sections is used for mixing the completely oxidized gas phase with the solid phase of the combustion products. The cooling section comprises at least a pair of gratings, with the space between the gratings being filled with pellets made of substances selected from aluminosilicate, silica gel or their mixtures, with a natural or preset moisture content.

The number and size of the meshes of the gratings used in the complete oxidation section and cooling section depend on the desired discharge flow velocity of the gas and aerosol mixture, and are determined by studying the gas dynamic drag of the sections.

For controlling the gas dynamic drag, diversely shaped pellets can be used (cylindrical, spherical) with various grading composition. The distance between the gratings defining the space filled with the pellets is very important. Each pair of gratings can be mounted with a desired spacing by putting a spacer ring of a predetermined height between them.

The fire-extinguishing apparatus also has a compensation device in the form of a spring that can be installed in various zones of the casing. This device compensates for the linear redistribution of the temperature profile during burning of the pyrotechnic composition and guarantees a constant distance between the maximum temperature zone of the temperature profile during burning and the complete catalytic oxidation section.

BRIEF DESCRIPTION OF THE ACCOMPANYING DRAWINGS

The invention will now be described in detail with reference to specific embodiments thereof illustrated in the accompanying drawings, in which.

DESCRIPTION OF THE PREFERRED EMBODIMENTS OF THE INVENTION

Figure 3:
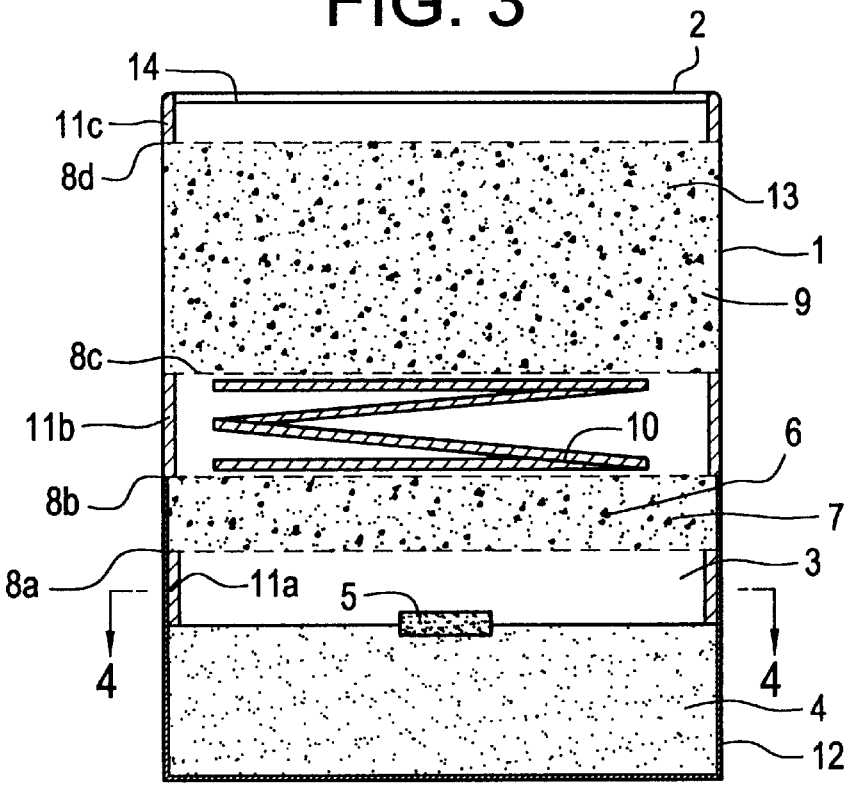
FIG. 3 is a first embodiment of a fire-extinguishing apparatus.

An apparatus shown in FIG. 3 has a cylindrical casing 1 with an inside diameter of about 50 mm, in which a pressed pyrotechnic composition 4 is located at the bottom end as shown in FIG. 3, with an igniter 5 positioned at the center of the composition. A spacer ring 11*a* that is 10 mm high is mounted on the top end of the composition 4, the outside diameter of the spacer ring corresponding to the inside diameter of the casing 1. A complete oxidation section 6 is installed on the spacer ring 11*a* and has two brass gratings 8*a*, 8*b* axially spaced within the casing 1, having a mesh diameter of 2.0 mm, and 10 g of synthetic zeolite 7 of the type A (NaY) with the natural moisture content are put between the gratings. Zeolite is in the form of spherical pellets (the pellet diameter ranges from 2.6 to 4.5 mm).

A combustion chamber 3 is formed inside the spacer ring 11*a* between the pyrotechnic composition and the cooling section 6.

The casing wall has a heat-insulating layer 12 in the zone of the composition 4, combustion chamber 3, and section 6.

A compensation device made as a steel spring 10 is provided on the grating 8*b*. The spring has a height of 12 mm and surrounds a spacer ring 11*b* that is 12 cm high, on which a cooling section 9 is installed, having a pair of brass gratings 8*c*, 8*d* made as nets with 2.0×2.0 mm mesh size, which are spaced apart axially within the casing 1. The space between the nets is filled with 30 g of spherical zeolite 13 of the type A (NaY) with the natural moisture content. A metal spacer ring 11*c* is placed on the top grating 8*d* of the cooling section 9, and a protective aluminum foil layer 14 0.2 mm thick is placed on the spacer ring that is connected to a discharge port 2 through foil that is wound on the end portion of the outer surface of the cylindrical casing.

Figure 5:
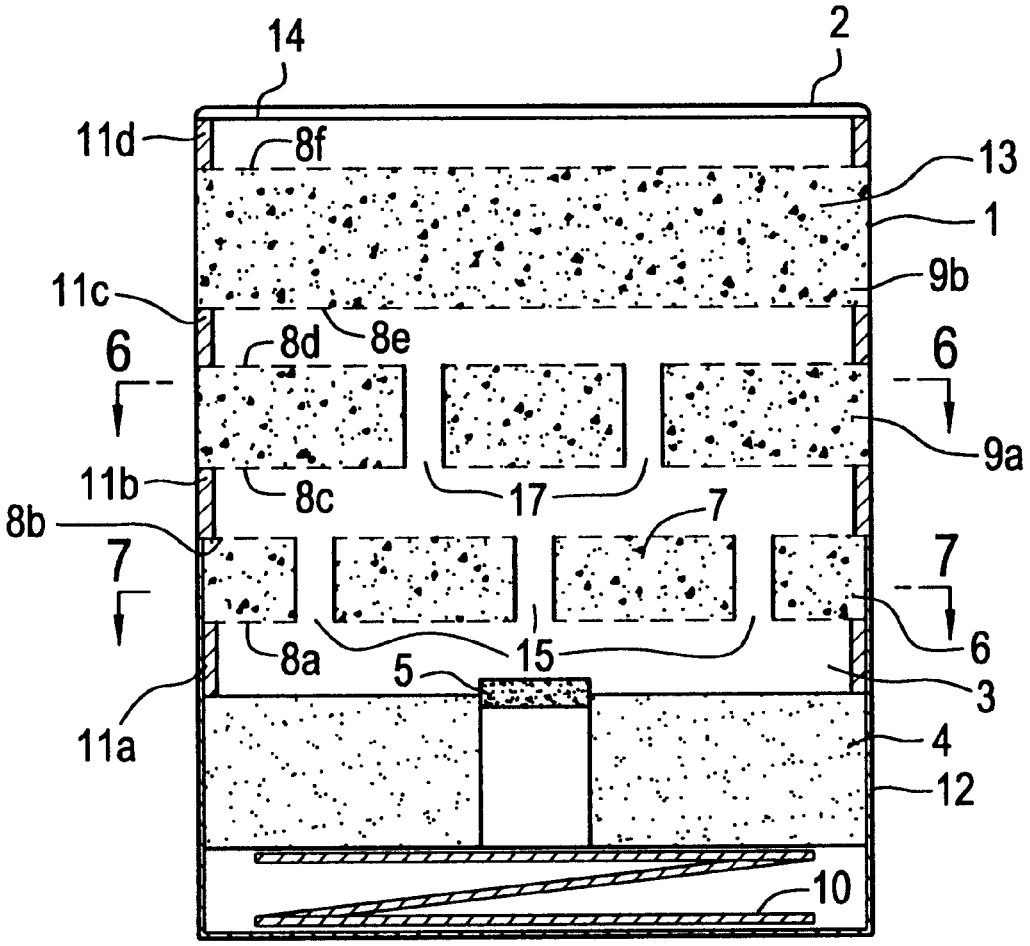
FIG. 5 is a second embodiment of a fire-extinguishing apparatus.
Figure 6:
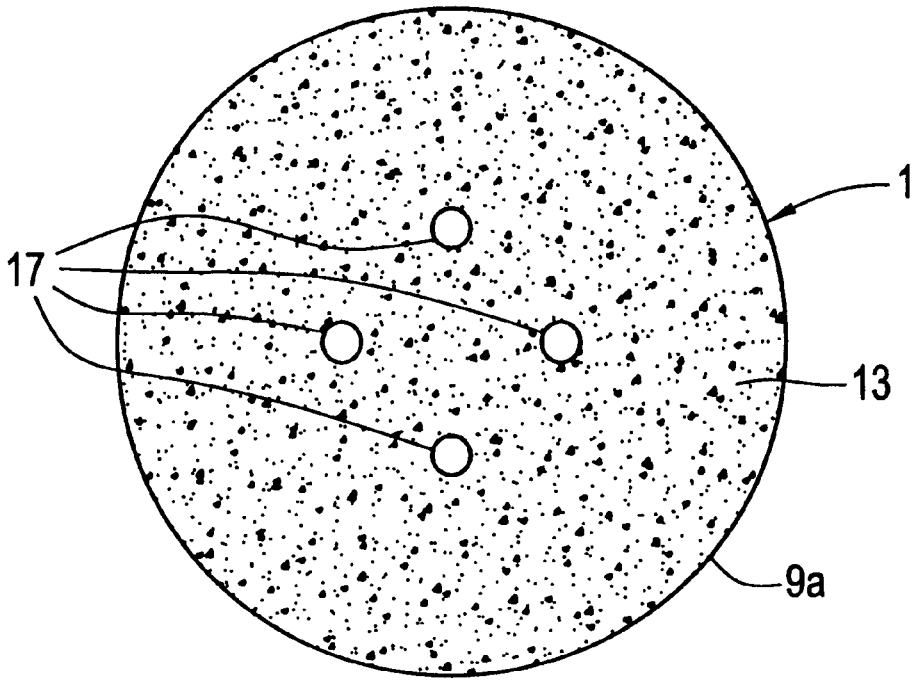
FIG. 6 is a sectional view taken along line A—A in FIG. 5.
Figure 7:
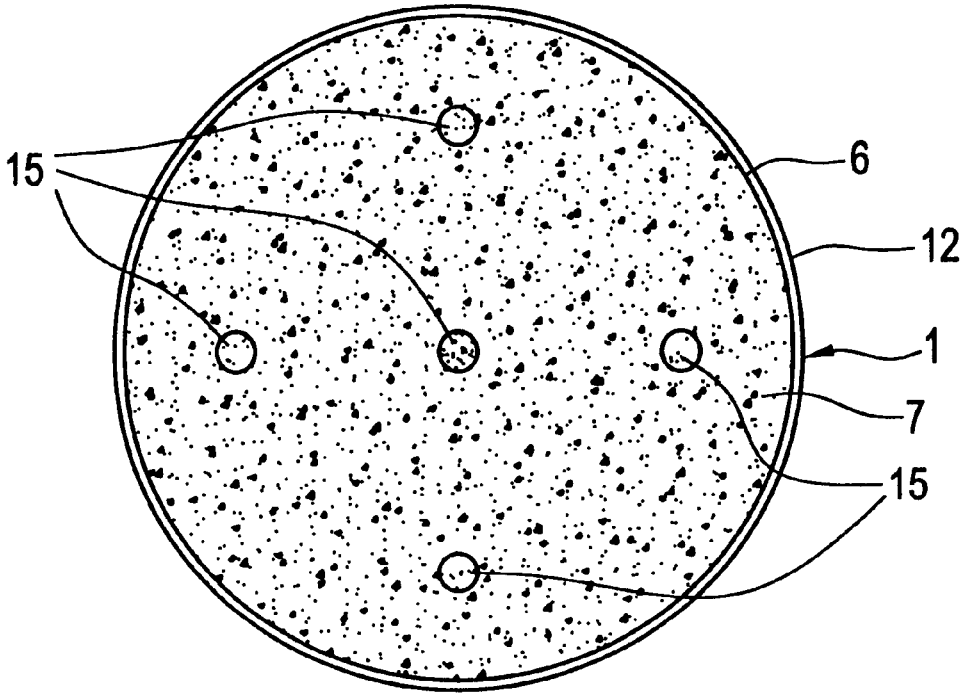
FIG. 7 is a sectional view taken along line B—B in FIG. 5.

The second embodiment of the apparatus shown in FIGS. 5 through 7 differs from the first embodiment by the fact that it has two cooling sections 9*a*, 9*b* that are spaced apart by interposition of a spacer ring 11*d*. The complete oxidation section 6 has four flow-through passages 15 extending lengthwise of the casing 1 and in which four flow-through passages 17 extend lengthwise of the casing 1 adjacent to the section 9*a* and adjacent to the passages 15. The spring 10 is provided under the composition 4 in the casing 1 to prevent the composition 4 from adhering to the walls of the heat insulating layer 12. The igniter 5 is installed in a central passage of the composition 4.

Figure 8:
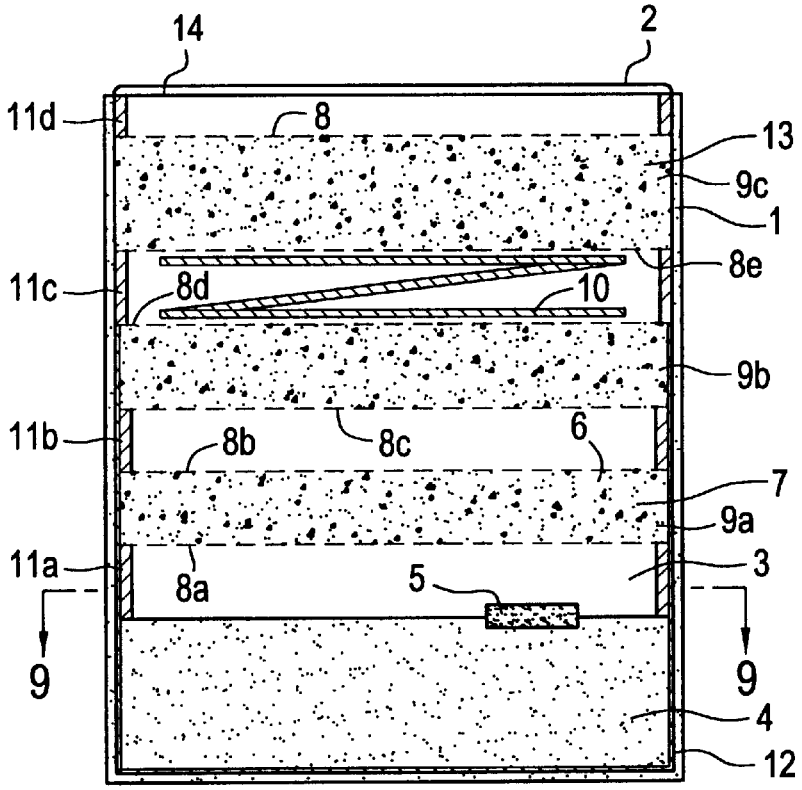
FIG. 8 is a third embodiment of a fire-extinguishing apparatus.
Figure 9:
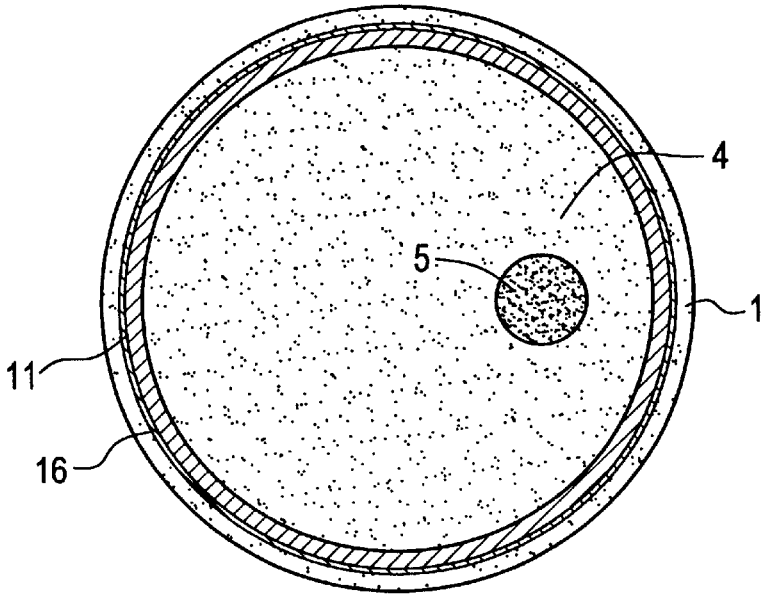
FIG. 9 is a sectional view taken along line A—A in FIG. 8.

In the third embodiment of the apparatus shown in FIGS. 8 and 9, there are two cooling sections 9*a*, 9*b*, and the spring 10 is positioned between the gratings 8*d*, 8*e* defining these sections. There are no passages in the sections 6 and 9*a*, 9*b*. The periphery 16 of the casing 1 has fins for heat insulation. A heat insulating material, e.g., such as zeolite particles, fills the space between the fins. The igniter 5 is offset from the central position in the composition.

The apparatus shown in FIG. 3 functions in the following manner.

In the case of fire, the igniter 5 of the pyrotechnic composition 4 provided in the combustion chamber 3 is initiated. The burning pyrotechnic composition 4 releases a hot gas and aerosol mixture that consists of a solid phase of the aerosol particles ($K_2CO_3$, $KHCO_3$, $NH_4HCO_3$, $KNO_2$, C, etc.) and a gas phase (CO, $CO_2$, NO, $NO_2$, HCN, $NH_3$, $CH_4$, $H_2O$). The resulting gas and aerosol mixture passes through the meshes of the grating 8*a* into the section 6 for complete catalytic oxidation, where it reacts with the aluminosilicate (zeolite) pellets 7.

Figure 1:
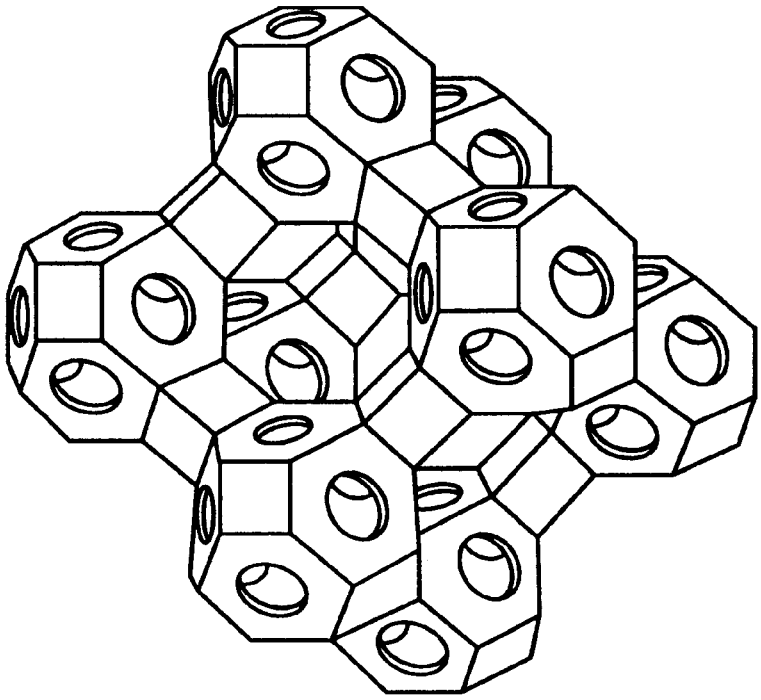
FIG. 1 is a type A zeolite structure.

The particles of the solid phase of the gas and aerosol mixture, which are substantially larger in size than the clear size of the interior of the zeolite pores (FIG. 1), do not enter the pores and flow around the outer surfaces of zeolite through the passages formed between the pellets when they are poured in.

The gases having molecules of a size not exceeding 0.4 nm (CO, $CO_2$, $NH_3$, NO, $NO_2$) flow through the openings of the zeolite structure into the pores that are formed around oxygen atoms, where their complete catalytic oxidation occurs at about 750° C.

To ensure stability of the chemical and mass composition of the gas phase, as well as stability of the temperature conditions, the pyrotechnic composition that is used has the above-described grading composition in the predetermined mass ratio.

To reduce the temperature fluctuations during the complete oxidation, which may result from the redistribution of the maximum temperature zone of the temperature profile, the apparatus has the steel spring 10 which exerts the spring force upon the complete catalytic oxidation section 6 in the spacer ring 11*a*. The height of the spacer ring 11*a* ensures the constant spacing between the maximum temperature zone of the temperature profile and the complete catalytic oxidation section 6 as the composition burns.

As the composition burns, the complete catalytic oxidation section 6 slowly follows the temperature profile that is being redistributed. In this manner, the complete catalytic oxidation section 6 remains within the zone of the maximum temperature until the end of the composition burning process.

Under pressure from the combustion products after the complete oxidation, the gas phase and the solid phase flow into the space defined between the complete oxidation section 6 and the cooling section 9, where they mix. The resulting gas and aerosol mixture is admitted to the cooling section 9. The cooling occurs through the interaction with the pellets of a coolant 13 comprised of zeolite, silica gel or their mixture, with a natural or preset moisture content. The heat of the gas and aerosol mixture is used for heating the pellets, for desorption of water, for water transformation into the vaporous state, and for conducting endothermic reactions (3).

When the gas and aerosol mixture flows through the cooling section 9, it is filtered as the gases are adsorbed on the surface of the zeolite pores, and the large aerosol particles are dispersed through collisions in the passages that are formed between the pellets of the coolant 13.

The cooling section 9 is fixed in the casing 1 by means of the spacer rings 11*a, b, c.*

The gas and aerosol mixture that is completely oxidized, cooled and filtered runs through the protective film 14 that can be comprised, e.g., of aluminum foil into the space being protected and extinguishes the fire.

By using a pyrotechnic composition with a progressive burning configuration (e.g., a cylinder with one or several passages of different configuration; two or several cylinders of the same diameter; two or several cylinders of different diameters; "tube-in-tube", etc.) when the gas and aerosol flow per unit of time is too high, the complete oxidation section 6 and the cooling section 9 are provided with additional passages 15 (FIGS. 6, 7), which allows the pressure to be reduced, thus assuring safe operation of the apparatus.

Example:

The apparatus of FIG. 3 was used for a test fire extinguishing operation. A pyrotechnic composition was used in the amount of 100 g. For its preparation, 18.33 g of a 60-% mixture of phenol-formaldehyde resin in ethanol were prepared in a blade stirrer. The content of the phenol-formaldehyde resin was 11.0 g.

The solution was heated in a water-jacket reactor to +50° C. and was processed in a stirrer at 85 RPM for one minute. The time for dissolving in ethanol was one hour. The finished solution did not contain any clots of non-dissolved resin.

To the above-mentioned quantity of solution, 17.5 g of potassium nitrate with a particle size of 15 to 25 $\mu$m were added, and the mixture was stirred for 5 minutes. Subsequently, 15.2 g of dicyandiamide with a particle size of 40 to 80 $\mu$m were added under stirring. After 5 minutes of stirring, 52.5 g of potassium nitrate were added with a particle size of 1 to 7 $\mu$m, and the mixture was stirred for 10 minutes after which 3.8 g of dicyandiamide with a particle size of 7 to 15 $\mu$m were added, and the mixture was stirred for 10 minutes. After the final addition, the mixture was dried on the rotating blades of the stirrer. The solution was blown at ambient air temperature with a gauge pressure of 1 kg/cm$^2$ for 15 minutes.

The resulting mixture was placed into a pelletizer that had the sizing chambers to prepare pellets of the mixture 3 mm long, with the following mass proportioning of the components: potassium nitrate 70±0.5% by mass, dicyandiamide 19±0.5% by mass, phenol-formaldehyde resin 11±0.5% by mass.

The resulting pellets were placed into a tray that was put into a drying cabinet at +45° C. After drying for 4 hours, the content of the residual liquid components did not exceed 0.8% by mass.

The resulting pellets were used to prepare a composition by pressing with a specific pressure of 1000 kp/cm$^2$ (100 MPa). The pressing was conducted at one stage with the rate of 0.003 m/s, with subsequent residence under pressure for 5 seconds in cylindrical heat insulation made of paper that defined a wall 1.5 mm thick.

As a result the pyrotechnic composition 4 was obtained as a 50-mm diameter cylinder without passages, with a recess in the middle in which the standard igniter 5 with a mass of 1 g was placed.

The apparatus was then assembled as shown in FIG. 3.

The assembled apparatus was used for extinguishing fire simulated by firing gasoline in a specially prepared space. The volume of the space being protected was 2.5 m$^3$ per 100 g of the pyrotechnic composition.

30 seconds after initiating use of the device, extinguishing of the gasoline fire formed by spilling gasoline on a 1-m$^2$ plate could be observed.

During the test, the following data were recorded: the burning rate of the pyrotechnic composition, the mass part of the solid phase in the aerosol, the mass part of the particles of 1 to 2 $\mu$m in the aerosol, the fire-extinguishing concentration, the combustion temperature for the composition, as well as the casing temperature, the temperature at the discharge port and at a distance of 200 mm from the discharge port (the measurements were conducted by the thermoelectric contact method with the help of chromel-alumel thermocouples having a junction diameter of 100 $\mu$m).

The analysis of composition of the toxic products in the gas and aerosol mixture was conducted by sampling through a line provided in the middle section of the test chamber.

To determine carbon monoxide and methane, gas samples were taken into a gas measuring tube and were then analyzed with the use of the thermal conductivity analyzer in a gas chromatograph. An extended chromatographic column of glass had a length of 2.4 m and the inside diameter of 2.5 mm. The flow rate of the carrier gas (helium) was 30 cm$^3$/min, the column temperature was 32° C., the batch was 1 cm$^3$. The chromatograms were recorded by means of TC-1601 Recorder. The results were plotted in volume percent and were estimated in terms of concentration in milligram per cubic meter for the following conditions: pressure 760 mmHg and temperature 293K. The detection limit was 0.001 by volume, which corresponded to the concentration of 11 mg/m$^3$.

For detection of ammonia, nitrogen oxides, and cyanides, the gas phase was stirred by means of a bubbler at a rate of 2 l/min over a collection flask with a glass filter during 10 minutes.

Ammonia was determined by using the colorimetry technique over a product of reaction with Nessler's reagent. The detection limit for the sample quantity (2 ml) was 2 $\mu$g, which corresponded to the concentration of 0.5 mg/m$^3$.

Nitrogen oxides were determined by the colorimetry technique over a product of reaction with Griess-Ilosvay's reagent. The detection limit for the sample quantity (2 ml) was 0.3 $\mu$g, which corresponded to the concentration of 0.075 mg/m$^3$.

Cyanides were determined by the colorimetry technique by reacting the emission with iron rhodanide. The detection limit for the sample quantity (5 ml) was 2 $\mu$g, which corresponded to the concentration of 0.1 mg/m$^3$.

Measurement results are given in the table below.

Composition, Rate of Combustion and the Fire-Extinguishing Characteristics for the Invention and Prior Art:

| Description of components of the composition | Component quantity in % by mass according to the invention, with the above-described particle distribution | Component quantity according to Patent RU 2 101 054 |
|---|---|---|
| Potassium nitrate | 70 | 70 |
| Dicyandiamide | 19 | 19 |
| Phenol-formaldehyde resin | 11 | 11 |
| Combustion rate in mm/s | 3.2 | 2.1 |

Fire-extinguishing characteristics of the apparatus (embodiments) according to the invention

Figure 2:
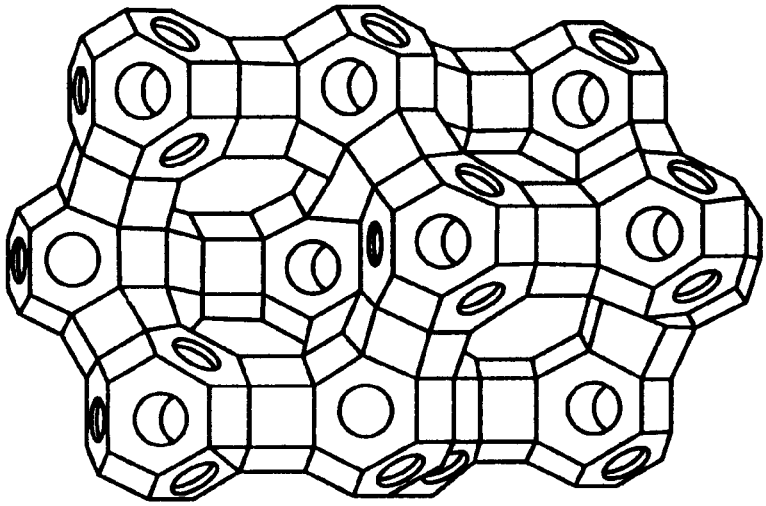
FIG. 2 is a type X zeolite structure.
Figure 4:
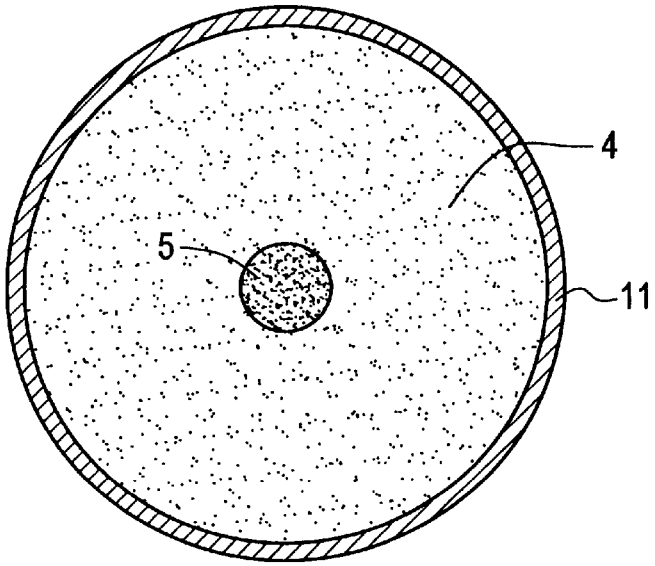
FIG. 4 is a sectional view taken along line A—A in FIG. 3.

| | FIG. 2 | FIG. 3 | FIG. 4 | Patent RU 2 101 054 |
|---|---|---|---|---|
| Yield of the solid phase of the gas and aerosol mixture | 70 | 69 | 71 | 57 |
| Mass part of the solid phase particles of 1 to 2 μm, % | 68 | 70 | 69 | 64 |
| Fire-extinguishing efficiency in g/m$^3$ | 36 | 38 | 34 | 40 |
| Temperature, ° C.: | | | | |
| Casing | 62 | 69 | 60 | — |
| Discharge port | 320 | 370 | 325 | — |
| 200 mm from the outlet | 115 | 136 | 118 | 160 |
| Toxic gas level, mg/m$^3$ | | | | |
| CO | 200 | 229 | 202 | 333 |
| $NH_3$ | 28 | 32 | 26 | 38 |
| HCN | 6 | 10 | 8 | 12 |
| $CH_4$ | 190 | 198 | 186 | No results |
| NO | 17 | 30 | 14 | 117 |

It will be understood that the above-described fire-extinguishing method in combination with the structural features of the apparatus ensures the preparation of a gas and aerosol mixture with reduced toxicity, lower temperature, and higher fire-extinguishing efficiency.

Industrial Application

The above-described fire-extinguishing method and the apparatus for carrying out the method ensure efficient fire extinguishing in various plants and buildings in which personnel at work are present, such as:

ventilation systems of residential buildings, hotels, industrial plants;

office spaces and industrial halls;

storage facilities, garages, etc.

As raw materials for the components are largely available and the above-described method and apparatus are simple and reliable, they can be used widely in industry.

The advantages of the above-mentioned method and of the apparatus for implementing the method are as follows: lower temperature and toxicity of the fire-extinguishing gas and aerosol mixture that is fed to the space being protected and absence of flames and sparks, with high fire-extinguishing efficiency.

What is claimed is:

1. A method for extinguishing fire, comprising the following steps of preparation of a gas and aerosol mixture to be fed to a space being protected:

a) igniting a pyrotechnic composition that ensures a predetermined combustion temperature profile and a predetermined composition of the gas and aerosol mixture to form incompletely burned combustion products;

b) causing the combustion products of the pyrotechnic composition to pass through a bed of a catalytically active substance, which is located in the zone of the maximum temperature of the combustion temperature profile, whereby the temperatures remain constant during the redistribution of the combustion temperature profile, and the incompletely burned combustion products are completely oxidized;

c) cooling the completely oxidized combustion products through interaction with materials having high heat-absorbing capacity simultaneously with filtering by composition and particle size.

2. The method of claim 1, wherein the pyrotechnic composition that ensures a predetermined composition of the gas aerosol mixture and a predetermined temperature profile comprises dicyandiamide as a gas and aerosol former, a polycondensate of formaldehyde with phenol as a combustible binder, and potassium nitrate as an oxidizer, wherein the gas and aerosol former, the combustible binder, and the oxidizer each consists of two fractions, respectively, 40 to 80 μm and 7 to 15 μm in the mass ratio of 80:20; 70 to 120 μm and 10 to 25 μm in mass ratio of 70:30; and 15 to 25 μm and 1 to 7 μm in the mass ratio of 25:75, with the following proportions of the components in the composition (% by mass):

| | |
|---|---|
| Gas and aerosol former | 9 to 20 |
| Combustible binder | 6 to 14 |
| Oxidizer | remainder. |

3. The method of claim 1, wherein the pyrotechnic composition that ensures a predetermined composition of the gas aerosol mixture and a predetermined temperature profile comprises gas and aerosol forming dicyandiamide with particles of 40 to 80 μm and 7 to 15 μm in the mass ratio of 10:90, the oxidizer, potassium nitrate with particles of 15 to 25 μm and 1 to 7 μm in the mass ratio of 5:95, and the combustible binder in the form of a polycondensate of formaldehyde with phenol, with the following proportions of the components in the composition (% by mass):

| | |
|---|---|
| Gas and aerosol former | 9 to 20 |
| Combustible binder | 6 to 14 |
| Oxidizer | remainder. |

4. The method of claim 1, wherein the material with high heat-absorbing capacity is selected from the group of aluminosilicates (zeolites), silica gel, and highly porous activated aluminum oxides.

5. The method of claim 1, wherein the complete catalytic oxidation is carried out on the surface of zeolite that is placed on a grating made of copper or another copper-containing metal.

6. The method of claim 1, wherein the complete catalytic oxidation is carried out on the surface of pellets of activated aluminum oxide having a porous structure, which is placed on a metal grating.

7. An apparatus for extinguishing fire, having a casing (1) that has a discharge port (2), a combustion chamber (3) that is accommodated in the casing (1) and heat insulated from the walls of the casing (1), a pyrotechnic composition (4)

and an igniter (5) that are received in the combustion chamber, a cooling section (9) and a complete catalytic oxidation section (6), characterized by the fact that the complete catalytic oxidation section includes a pair of spaced metal gratings (8*a,* 8*b*), between which the catalytically active substance is located that the complete catalytic oxidation section (6) is at a constant distance from the pyrotechnic composition (4) and that a compensation device (10) is provided, which ensures the maintenance of said constant distance during burning of the combustion composition.

8. The apparatus of claim 7, wherein the compensation device (10) is provided between the cooling section (9) and the discharge port (2).

9. The apparatus of claim 7, wherein the compensation device (10) is provided in the zone of the casing bottom.

10. The apparatus of claim 7, wherein the compensation device (10) is provided between the complete oxidation section (6) and the cooling section (9).

11. The apparatus of claim 7, wherein the compensation device (10) comprises an elastic member of spring steel.

* * * * *